United States Patent [19]

Coffey et al.

[11] Patent Number: 4,898,322

[45] Date of Patent: Feb. 6, 1990

[54] AUTOMATED MACHINE ENVELOPE

[75] Inventors: James B. Coffey, Dayton, Ohio; Leslie B. Gwynn, Winston-Salem, N.C.

[73] Assignee: NCR Corporation, Dayton, Ohio

[21] Appl. No.: 259,371

[22] Filed: Oct. 18, 1988

[51] Int. Cl.[4] ..... B65D 27/00

[52] U.S. Cl. ..... 229/69; 229/92.1; 229/73

[58] Field of Search ..... 229/69, 73, 92.1, 92.8; 282/25

[56] References Cited

U.S. PATENT DOCUMENTS

| | | | |
|---|---|---|---|
| 2,196,461 | 4/1940 | Heywood | 282/25 |
| 2,256,184 | 9/1941 | Allen | 282/25 |
| 2,678,769 | 5/1954 | David | 229/73 |
| 2,840,295 | 6/1958 | Fromm | 229/73 |
| 3,419,286 | 12/1968 | Noonan et al. | 229/69 |
| 3,428,237 | 2/1969 | Dowen | 229/73 |
| 3,608,881 | 9/1971 | Neubauer . | |
| 3,790,070 | 2/1974 | Schnitzer | 229/92.8 |
| 3,833,167 | 9/1974 | Kapitan | 229/73 |
| 3,942,714 | 3/1976 | Wise | 229/73 |
| 3,952,871 | 4/1976 | Erickson . | |
| 3,952,942 | 4/1976 | O'Leary et al. | 229/73 |
| 3,981,435 | 9/1976 | Johnsen | 229/73 |
| 4,047,661 | 9/1977 | Klein . | |
| 4,113,281 | 9/1978 | Halse . | |
| 4,343,430 | 8/1982 | Martineau . | |
| 4,418,865 | 12/1983 | Bowen . | |
| 4,493,496 | 1/1985 | Kaluza . | |
| 4,524,903 | 6/1985 | Vath | 229/73 |
| 4,585,160 | 4/1986 | Fiske . | |
| 4,624,481 | 11/1986 | Kercher . | |
| 4,682,793 | 7/1987 | Walz | 229/69 |
| 4,690,433 | 9/1987 | Showers et al. | 229/92.1 X |
| 4,709,850 | 12/1987 | Wagner . | |
| 4,747,535 | 5/1988 | Haase et al. | 229/73 |
| 4,756,468 | 7/1988 | Jenkins | 229/73 |

FOREIGN PATENT DOCUMENTS

| | | | |
|---|---|---|---|
| 1432758 | 4/1976 | United Kingdom | 282/25 |

*Primary Examiner*—Stephen Marcus
*Assistant Examiner*—Jes F. Pascua
*Attorney, Agent, or Firm*—Wilbert Hawk, Jr.; Albert L. Sessler, Jr.; George J. Muckenthaler

[57] ABSTRACT

A business form for use in an automated teller machine for business transactions. The business form is constructed of multiple plies to provide the user with a receipt of the transaction and to provide an envelope for enclosing a deposit slip or copy of the receipt for use by the business entity. The business form provides a means for both parties to have a copy of the business transaction for verification thereof.

20 Claims, 3 Drawing Sheets

AUTOMATED MACHINE ENVELOPE

BACKGROUND OF THE INVENTION

In present-day data processing systems, the use of automatic teller machines is well known as a means for making a deposit or for obtaining cash or for other business transactions. The automated teller machine accepts a bank card which may include means identifying the customer, such as a personal identification number (PIN), a bank identifying number, and an account number. Of course, additional data or information may be required of the system in the overall arrangement depending on the complexity of the business operation.

While the format and arrangement of printed information on the bank card varies for each business establishment, certain information is desirable to provide a record of the transactions. The printed information on documents used in the banking transaction may include the name and address of the customer and the business, the amount and kind of transaction, time, date or other like information.

It is also known that the documents used or required in the transaction may comprise a single sheet or ply on which is printed the essential information relative to the banking transaction and that a portion of the document may be easily removable along a line of perforations for providing and/or retaining a record of the transaction.

The document may comprise a back or bottom ply on which is printed the essential information along with a bank code symbol or like machine readable mark, and a front or top ply which may be secured to the back or bottom ply by means of a line of adhesive or the like. The front or top ply may extend over a portion or all of the back or bottom ply and may be removable therefrom by the customer or user for the desired use.

Another arrangement comprises a multiple ply document which includes the printed information including the bank symbol on all plies and wherein the plies are secured together by means of a line of adhesive along one edge of the document.

A further arrangement uses a business form in the nature of an envelope having a back ply, a label removable from the back ply, and a front ply for covering the label.

While the just-mentioned various business forms provide a record of a transaction, it is desirable and is requested by certain business institutions, such as banks and savings and loan businesses, that an identical receipt or record of the business transaction and the specifics thereof be provided for the customer and for the business.

Representative documentation relating to multiple ply business forms includes U.S. Pat. No. 3,608,816, issued to F. H. Neubauer on Sept. 28, 1971, which discloses a continuous series of envelopes wherein each envelope contains a permanent adhesive along three edges to seal the front and back portions and form a packet for housing an insert. The front and back portions are bonded along the remaining edge by a releasable adhesive.

U.S. Pat. No. 3,952,871, issued to A. J. Erickson on Apr. 27, 1976, discloses a machine loadable multipocket, multi-section article carrier stock having a marginal strip and transverse score lines and leaves bonded together at one end of each carrier section.

U.S. Pat. No. 4,047,661, issued to B. Klein on Sept. 13, 1977, discloses an envelope comprising front and back panels interconnected along three edges thereof forming a first pocket and having an insert opening between the edges of the panels. A center flap is connected to the remaining edge of the back panel along a fold line and overlies a portion of the back panel.

U.S. Pat. No. 4,113,281, issued to P. W. Halse on Sept. 12, 1978, discloses a continuous business forms assembly having upper and lower webs with intermediate webs. The bottommost intermediate web is fan-fold type and has a front cover in underlying relationship and connected to an adjacent web along a fold line.

U.S. Pat. No. 4,343,430, issued to J. P. Martineau on Aug. 10, 1982, discloses an envelope assembly having two outer panels, a partition panel, and an envelope flap integral with one outer panel. The partition panel is sealed along all four sides to one outer panel to provide a compartment which may be opened by tear line perforations adjacent one pin hole feed strip.

U.S. Pat. No. 4,418,865, issued to C. G. Bowen on Dec. 6, 1983, discloses a mailer assembly with a front ply and a back ply secured by a U-line of adhesive. The back ply has a flap portion which overlies a tab portion by means of releasable or fugitive glue spots.

U.S. Pat. No. 4,493,496, issued to R. T. Kaluza on Jan. 15, 1985, discloses a multiple ply assembly having individual sheets and a travelers ticket holding folder formed by lines of adhesive and having a line of perforations extending laterally across a panel of the folder.

U.S. Pat. No. 4,585,160, issued to W. W. Fiske on Apr. 29, 1986, discloses a negotiable instrument mailing device having an addressee panel, a return address panel and a negotiable instrument panel.

U.S. Pat. No. 4,624,481, issued to D. M. Kercher on Nov. 25, 1986, discloses a combination multiple ply manifold business form and airline ticket jacket.

And, U.S. Pat. No. 4,709,850, issued to D. G. Wagner on Dec. 1, 1987, discloses a mailer including a return envelope and a remittance stub combined in the outer envelope.

SUMMARY OF THE INVENTION

The present invention relates to multiple ply documents for use in business establishments. More particularly, the present invention relates to a business form on which is printed certain business information and which includes space for recording transaction information in addition to space occupied by identification means or like indicia.

The multiple ply business form includes a back or bottom ply of a weight which is sufficient to generally support itself. In a preferred embodiment of the invention, a top ply slightly smaller in size than the back ply is attached thereto along a perforated edge. At least one middle or intermediate ply of slightly smaller size than the back ply is secured by means of lines of glue or adhesive to the back ply along three edges thereof.

The business form also includes at least two additional plies which are slightly smaller in size than the back ply and the intermediate ply. One of the additional plies is secured to the intermediate ply and the other one of the additional plies is secured to the one additional ply and arranged in a manner to provide underlying plies, respectively. The two additional plies are secured to the underlying plies by means of spots of adhesive across the upper portions of the business form, and the lower portions of the plies are connected to the upper portions by lines of weakening adjacent the spots of adhesive so as to enable removal of the lower portions. The additional plies serve as receipts or records of the banking transaction for the user and also as a record for the bank or like business. One of the additional plies is removed from the business form or unit set and is placed in an envelope or pocket formed by the back ply and the intermediate ply. The cover or top ply, constructed as an extension of the back or bottom ply, is a wide flap or closure and is folded over the remaining additional ply and adhered thereto and the sealed envelope is then placed into the automated machine.

A modification of the business form of the present invention uses a back ply, an intermediate ply and at least two additional plies in a similar arrangement to the preferred embodiment. However, instead of a top or cover ply, a narrow flap or closure is provided as an extension of the back ply and such extension is folded over an edge of the intermediate ply to seal the pouch or pocket formed by the back ply and the intermediate ply.

In view of the above discussion, a principal object of the present invention is to provide a multiple ply document which is acceptable for automated machine operation and includes portions of the respective plies which are removable from the document.

Another object of the present invention is to provide a multiple ply business form which provides a record of a financial or other transaction for the customer and for the business.

An additional object of the present invention is to provide a multiple ply business form which includes imprinted information on at least two of the plies and which plies serve as a record of the information for the customer and for the business.

A further object of the present invention is to provide a multiple ply business form which includes a back ply and an intermediate ply which are secured to each other to form an envelope, at least two additional plies with printed information thereon and removable from the business form to provide a specific record of the information for the customer and for the business, and a cover or closure ply for sealing the envelope to facilitate placing thereof into a business machine.

Additional advantages and features of the present invention will become apparent and fully understood from a reading of the following description taken together with the annexed drawing.

DESCRIPTION OF THE PREFERRED EMBODIMENT

Prior to describing the invention in detail, it is noted that in banking or like business transactions, a record of such transactions is desirable by both the customer or user and by the bank or other business. The record provides both the customer and the bank with proof of the transaction for later verification by either party. The construction of the business form of the present invention provides that the customer enters certain information on the form and the form is then used in conjunction with an automated teller machine or like business equipment. The customer retains one ply or sheet of the business form containing the information for his file and places another ply of the form containing the identical information in the envelope or pocket of the form which envelope is then deposited into the machine. A supply of the business forms may be placed in a tray or receptacle adjacent the automated machine or a supply of such forms may be contained within the machine for use by the customer.

The business form uses imaging paper (carbonless or coated paper) wherein crash imprinted or impact printed information has been provided thereon by the bank, and manually written information is entered on the form by the customer at the time of the transaction. The bank information may include a bank name, a code or symbol, an address and a bank account number, and the customer information may include a name, address and account or identification number along with written information concerning the instant transaction.

Figure 1:
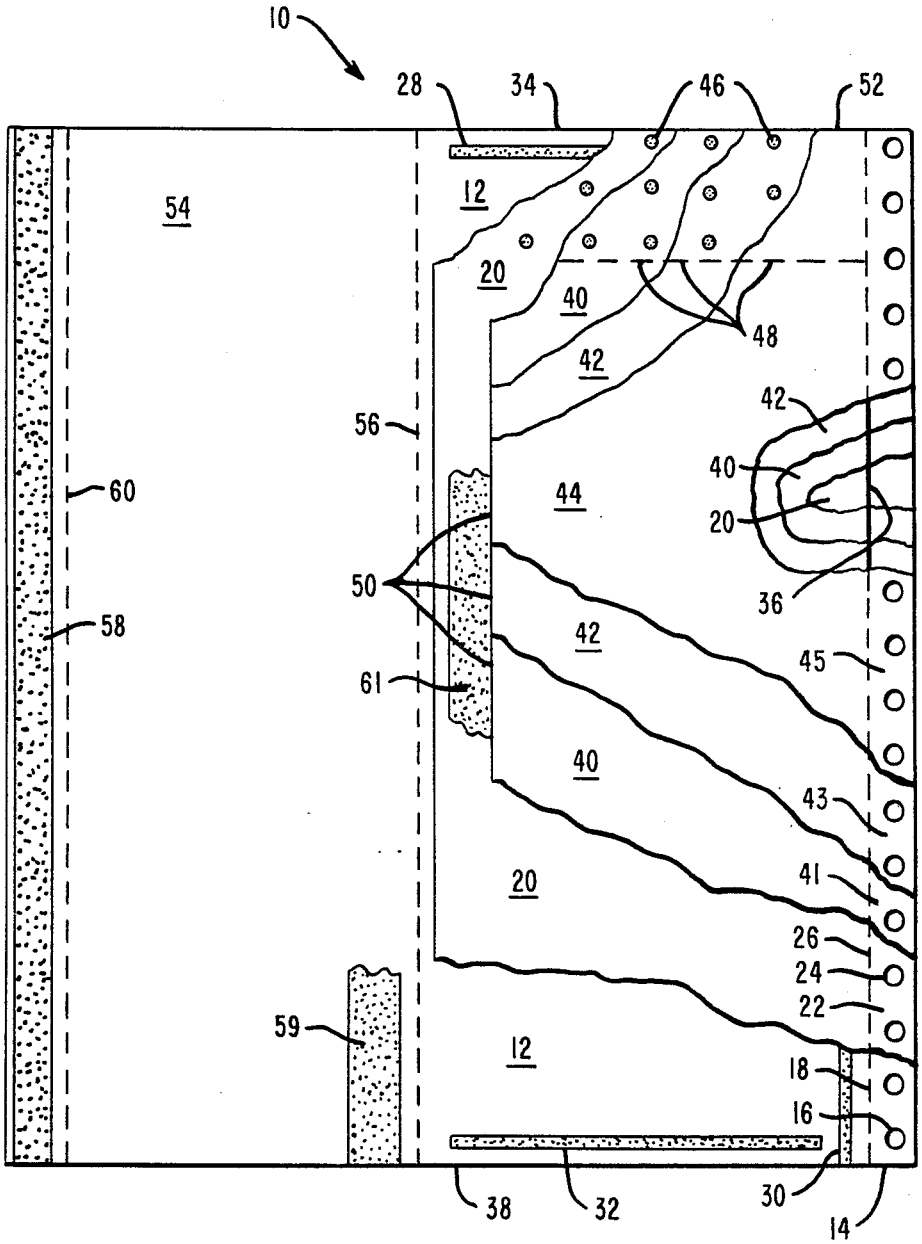
FIG. 1 is a top or front plan view of a preferred arrangement for a business form incorporating the subject matter of the present invention.
Figure 2:
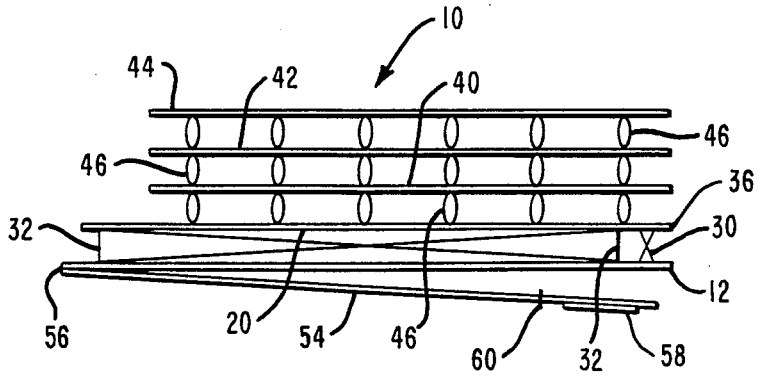
FIG. 2 is an end view of the business form with the several plies being separated in exaggerated manner to show the construction.

Referring now to FIGS. 1 and 2 of the drawing, there is shown a top or front view of a business form 10 of the continuous form type, and an end view of the business form which incorporates the subject matter of the present invention. A preferred construction of the business form 10 includes a first or back ply or panel 12 that is made of 20 pound bond paper and measures 8.125 inches by 9.5 inches, this dimension including a left hand portion in an open or extended position, as illustrated in FIG. 1. FIG. 2 shows the left hand portion of the back ply 12 folded under the right hand portion of the back ply as exemplified by positions of these portions when a plurality of the forms 10 are in a stack for use by the customer. A margin strip 14 (FIG. 1) of one-half inch in width and including drive pin holes 16 is connected to the back ply 12 along one side or edge thereof by a line of weakening 18.

A second or intermediate ply or panel 20 is made of 20 pound coated front (CF) paper and measures 4 inches by 9.5 inches. The ply 20 includes a margin strip 22 (FIG. 1) with pin holes 24 therein which strip is connected to the intermediate ply 20 along one side thereof by a line of weakening 26. The intermediate ply 20 is secured to the back ply 12 by means of three lines of glue or adhesive 28, 30, 32. The glue line 28 is placed along the top or upper edge 34 of the business form 10, the glue line 30 is placed along the side edge 36 of the form, and the glue line 32 is placed along the lower edge 38 of the form. The side edge 36 of the form 10 is illustrated in the manner wherein the margin strips have been removed from each of plies 20, 40, 42 and 44.

A plurality (three) of third or additional plies 40, 42, and 44 preferably made of carbonless paper and measuring 3.5 inches by 9.5 inches are placed on top of the intermediate ply 20 (FIG. 2). The additional plies 40, 42 and 44 serve as receipts and include information concerning the business transaction. Plies 40 and 42 are made of 14 pound coated front and back (CFB) paper and ply 44 is made of 15 pound coated back (CB) paper. The additional plies 40, 42 and 44 include margin strips 41, 43 and 45, respectively, which are used in the collating process in producing the form 10 and which strips are removed by the producer of the forms. Of course, the margin strips 41, 43 and 45 also include drive pin holes aligned with the pin holes 16 and 24 in margin strips 14 and 22, respectively. The information ply 40 is secured to the intermediate ply 20 by means of a pattern of dots or spots of glue or adhesive, as 46, positioned across the top or upper portion of the form 10 (FIG. 1). The illustrated matrix pattern of dots or spots of glue or adhesive is applied by means of a programmable cross and pattern gluing machine (not shown). The lower additional ply 40 is secured to the intermediate ply 20 by a pattern of 18 dots, the middle additional ply 42 is secured to the ply 40 by a pattern of 18 dots and the upper additional ply 44 is secured to the middle ply 42 by a pattern of 18 dots.

The measurements of the various plies 12, 20, 40, 42 and 44 are recited in dimensions less the margin strips 14, 22, 41, 43 and 45, it being noted that such margin strips are removed by the forms producer when manufacturing the business form 10.

A line of weakening or perforations 48 (FIG. 1) is provided in each of the plies 40, 42 and 44 adjacent the pattern of glue spots 46. The line of perforations 48 in each of plies 40, 42 and 44 enables selective removal of the lower portion 50 of each ply 40, 42 and 44 and leaves a glued stub portion 52 remaining with the business form 10.

A closure ply or flap 54 (which actually is connected as the left hand portion of the back ply 12) is connected by means of a fold line of weakening or perforations 56 extending the length of the form 10 (FIG. 1), the ply or flap 54 measuring 4 inches by 9.5 inches. The flap 54 is of sufficient size to substantially cover the intermediate ply 20 and to provide a seal for the pocket or pouch formed by the back ply 12 and the intermediate ply 20. A one-half inch width of adhesive transfer tape 58 is provided along one edge of the length of the closure flap 54 (FIG. 1) on one side thereof and serves to seal the pocket by covering one or more of the additional or information plies or receipts, as 40, 42, or 44, and the intermediate ply 20. The tape 58 is placed one-eighth inch from the edge of the flap 54 and a fold back line of weakening or perforations 60 is provided at one-eighth inch from the inner edge of tape 58. FIG. 2 shows the wide flap 54 in a prefolded condition or in the position when the customer takes a business form 10 from a stack, the flap 54 being shown folded under the several plies 20, 40, 42 and 44 but partially open for clarity.

An alternative location for the strip of adhesive transfer tape 58 may be shown as a strip of tape 59 (FIG. 1) on one side of the closure ply 54 or as a strip of tape 61 on one side of the intermediate ply 20. It should be noted that remoistenable glue can be substituted for the adhesive transfer tape which glue or tape permits easy opening of the pocket.

Figure 4:
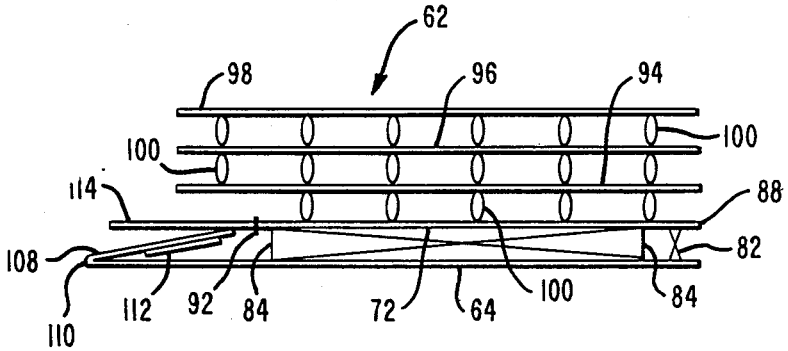
FIG. 4 is an end view of the modified business form with the several plies being separated to show the construction.
Figure 3:
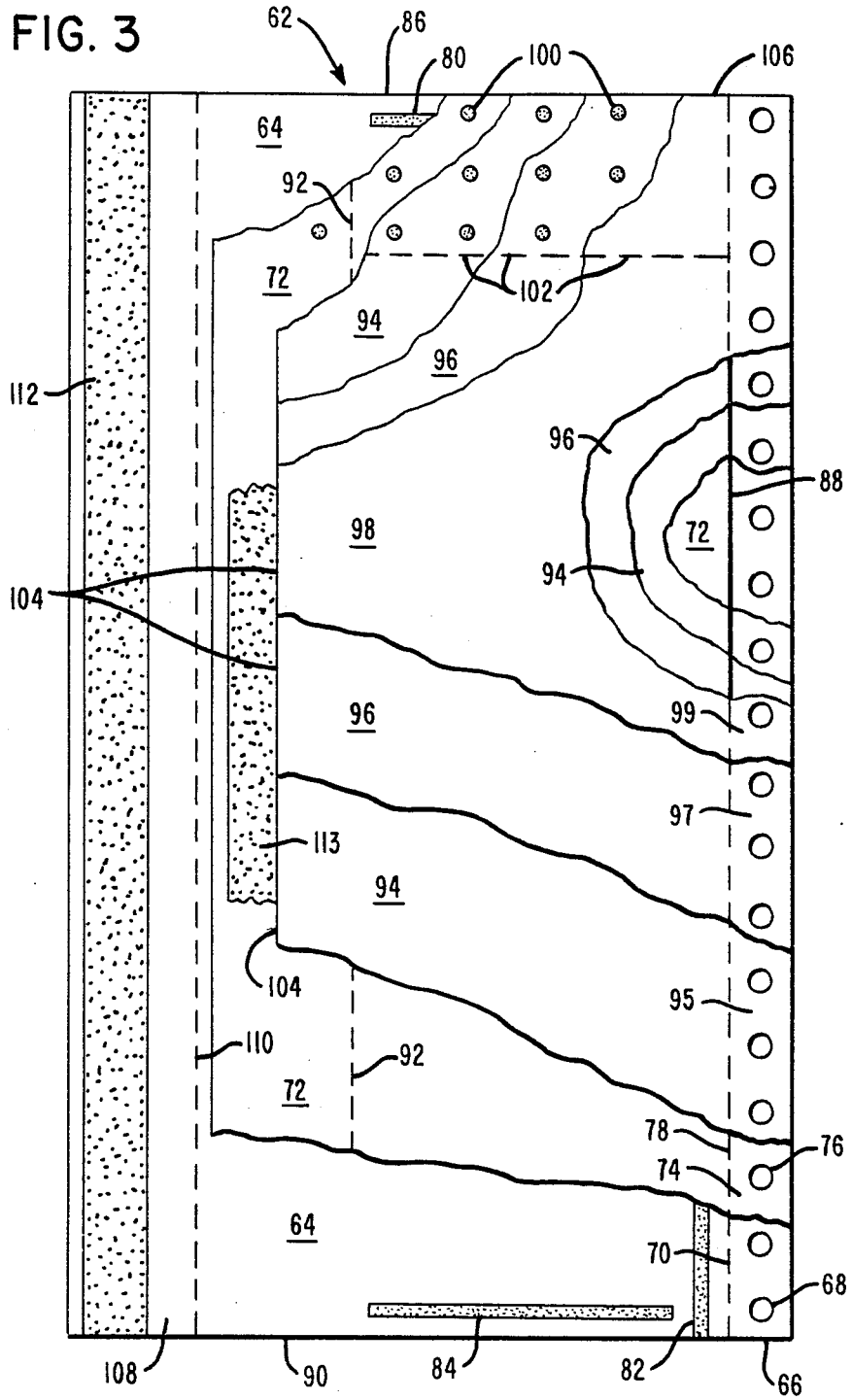
FIG. 3 is a top or front plan view of a modified business form incorporating the subject matter of the present invention.

FIGS. 3 and 4 show a modification of the business form of the present invention. FIG. 3 shows a top or front view of a business form 62 of the continuous form type, and FIG. 4 shows an end view or construction diagram of the business form or unit set 62. The first or back ply or panel 64 is made of 20 pound bond paper and measures 5.125 by 9.5 inches, this measurement including a left hand portion in an open or extended position, as illustrated in FIG. 3. FIG. 4 shows the left hand portion of the back ply 64 folded upwardly over such back ply at the left hand side thereof and as exemplified by positions of these portions when a plurality of the forms 62 are placed in a stack for use by the customer. A margin strip 66 (FIG. 3) of one-half inch in width and including drive pin holes 68 is connected to the back ply 64 along one side or edge thereof by a line of weakening 70.

A second or intermediate ply or panel 72 is made of 20 pound CF paper and measures 4 inches by 9.5 inches. The ply 72 includes a margin strip 74 (FIG. 3) with pin holes 76 therein which strip is connected to the intermediate ply 72 along one side thereof by a line of weakening 78. The intermediate ply 72 is secured to the back ply 64 by means of three lines of glue or adhesive 80, 82 and 84. The glue line 80 is placed along the top or upper edge 86 of the business form 62, the glue line 82 is placed along the side edge 88 of the form, and the glue line 84 is placed along the lower edge 90 of the form. The side edge 88 of the form 62 is illustrated in the manner wherein the margin strips have been removed from each of plies 72, 94, 96 and 98. The intermediate ply 72 includes a fold back line of weakening or perforations 92 along the length thereof, distal from the side edge 88, and adjacent one end of the glue lines 80 and 84 (FIG. 3).

A plurality (three) of third or additional plies 94, 96 and 98 preferably made of carbonless paper and measuring 3.5 inches by 9.5 inches are placed on top of the intermediate ply 72 (FIG. 4). The additional plies 94, 96 and 98 serve as receipts and include information concerning the business transaction. Plies 94 and 96 are made of 14 pound CFB paper and ply 98 is made of 15 pound CB paper. The additional plies 94, 96 and 98 include margin strips 95, 97 and 99, respectively, which are used in the collating process in the production of the form 62 and which strips are removed by the producer of the forms. Of course, the margin strips 95, 97 and 99 also include drive pin holes aligned with the pin holes 68 and 76 in margin strips 66 and 74, respectively. The information ply 94 is secured to the intermediate ply 72 by means of a pattern of dots or spots of glue or adhesive, as 100, positioned across the top or upper portion of the form 62 (FIG. 3). The illustrated matrix pattern of dots or spots of glue or adhesive 100 is applied by means of a programmable cross and pattern gluing machine (not shown). The middle additional ply 96 is secured to the lower additional ply 94 by a pattern of 18 dots of glue and the upper additional ply 98 is secured to the middle ply 96 by a pattern of 18 dots of glue. There are no dots or spots of glue or adhesive between the intermediate ply 72 and the lower additional ply 94 outside the line of weakening 92, so the glue pattern of 15 dots which secures the lower additional ply 94 to the intermediate ply 72 is different from the glue pattern of dots 100 between plies 94 and 96, and the glue pattern of dots 100 between plies 96 and 98.

The measurements of the various plies 64, 72, 94, 96 and 98 are recited in dimensions less the margin strips 66, 74, 95, 97 and 99, it being noted that such margin strips are removed by the forms producer.

A line of weakening or perforations 102 (FIG. 3) is provided in each of the plies 94, 96 and 98 adjacent the pattern of glue spots 100. The line of perforations 102 in each of the plies 94, 96 and 98 enables selective removal of the lower portion 104 of each ply 94, 96 and 98 and leaves a glued stub portion 106 remaining with the business form 62.

A closure flap 108 (which actually is connected as the left hand portion of the back ply 64) is connected by means of a fold line of weakening or perforations 110 extending the length of the form 62 (FIG. 3) and the flap measures 1 inch by 9.5 inches. When the customer takes a form 62 from a stack, the flap 108 is folded toward and over the top side of the back ply 64. A one-half inch width of adhesive transfer tape 112 is provided along one edge of the length of the closure flap 108 (FIG. 3) on one side thereof and serves to seal the pocket which is formed by the back ply 64 and the intermediate ply 72. The tape 112 is placed one-eighth inch from the edge of the flap 108 and the line of weakening 110 is positioned at one-eighth inch beyond the edge of the intermediate ply 72 (FIG. 3). FIG. 4 shows the narrow flap 108 in a prefolded condition or in the position when the customer takes a business form 62 from a stack, the flap 108 being shown folded under a left hand portion 114 of ply 72 but partially open for clarity.

An alternative location for the strip of adhesive transfer tape 112 may be shown as a strip of tape 113 (FIG. 3) on the top surface of the intermediate ply 72. It is noted that remoistenable glue can be substituted for the adhesive transfer tape to permit easy opening of the pocket.

In the use of the invention with the wide flap construction, as illustrated in FIGS. 1 and 2, a customer selects one of the business forms 10 and enters information regarding the business transaction on the face of the information ply 44. This information is also transferred to plies 20, 40 and 42 by reason of the carbonless paper concept. The customer may add instructions or like information on the top side of closure flap 54 (the side that includes the strip of tape 58). The customer then removes the ply 44 (and perhaps plies 40 and 42), depending upon the type of transaction, along the line of perforations 48 (FIG. 1) for retaining a record of the transaction. A check or other document may be placed into the pocket formed by the back ply 12 and the intermediate ply 20 and the closure flap 54 is then folded over the top of the business form 10 and such form is then placed into the automated machine. Alternatively, the completed business form may be placed in a receptacle or other location or position provided by the business for retrieving such form to have a record of the transaction. One information ply, as 40, is removed and placed inside the pocket and remains with the business form 10. The manually entered information, appearing as an image on the face of ply 20, is covered with the top ply 54. The adhesive strip 58 seals the ply 40 along the right hand side of the form 10 which includes the pocket formed by the back ply 12 and the additional ply 20. It is noted that the information entered on ply 44 by the customer also is recorded on ply 42, 40 and 20. Although the entered information appears on ply 20, the business may also have need for the one information ply 40.

The use of the business form 62 with the narrow flap construction (illustrated in FIGS. 3 and 4) is similar to that for the use of the business form 10. Information regarding the business transaction is entered by the customer on the face of the information ply 98, such information being transferred to plies 72, 94 and 96. The customer then removes the ply 98 (and perhaps ply 96) along the line of perforations 102 (FIG. 3) for retaining a record of the transaction. A check or other document may be placed into the pocket formed by the back ply 64 and the intermediate ply 72. The narrow flap 108 is then folded over the side portion of the intermediate ply 72 and the form is then placed into the automated machine. It is seen from FIG. 4 that since there are no glue spots, as 100, outside or to the left of the line of perforations 92 on ply 72, the flap 108 is placed over the top of the left-hand portion 114 of ply 72. The line of adhesive or transfer tape 112 then secures the flap 108 over the top of and to the portion 114. One information ply, as 94, is removed and placed inside the pocket and remains with the business form 62. The manually entered information, appearing as an image on the face of ply 72, is exposed.

As illustrated in FIG. 1, the additional plies 40, 42 and 44 of the business form or unit set 10 are designed with the glued stub portion 52 attached to the leading edge of the form as produced on the collator. The location of the glued stub portion 52 and the line of perforations 48 are strategically located on the leading edge of the form 10. The location of the glued stub portion 52 on the leading edge prevents ragged or dog-eared edges of the additional plies, as 40, 42 and 44, in the process of collating. The line of perforations 48 is located away from the leading edge of the form to provide ample strength when undergoing the dot gluing operation and thereby prevents shingling of the finished unit set. The line of perforations 48 is also located to provide that the receipt or lower portion 50 can be conveniently placed or inserted in a flat, unfolded condition by the customer into the pocket or pouch formed by the back ply 12 and the intermediate ply 20. Similar conditions exist in the production of the business form 62, illustrated in FIG. 3.

The alternative location for the pressure sensitive tape 58 or for remoistenable adhesive can be located adjacent the pocket or pouch opening, as by strip 61, on the front side of the back ply 12 of form 10 (FIG. 1) or as by strip 113 on the front side of the portion 114 of the ply 72 of form 62. This alternative location of the tape or adhesive along the top surface of the intermediate ply at the left hand side thereof can be used for either the wide flap or the narrow flap construction.

The fold back line of perforations 56 of business form 10 provides a convenient means for access to any information that is either printed or crash imprinted on the face of ply 20 after the envelope has been sealed and then reopened to remove the contents from the envelope or pouch formed by plies 12 and 20. The line of perforations 56 can be provided at other locations when using the wide flap construction, and the sealed envelope can be opened at the flap fold line of perforations 56 by any letter opening device. The line of perforations 60 acts as a hinge point for the flap portion 54 after the envelope pocket is closed and then opened thus providing easy access to any image on ply 20.

The business form can be produced by means of a collator and a glue machine to provide either a wide flap 54 construction or a narrow flap construction. The wide flap 54 or the narrow flap 108 is formed and provided as a prefolded envelope which may be dispensed from a stack, used by the customer, and then deposited in the automatic teller machine. The wide flap 54 provides space for additional information or instructions to be written on the left hand portion of the form 10 and also the closure flap can cover confidential information. Further, the wide flap 54 can be used in a manner to expose information on the intermediate ply 20 even after the envelope is sealed by placing the adhesive strip in the alternative location, as 61, adjacent the opening of the pocket. Placing the adhesive strip at such alternative location 61 provides for sealing items inside the envelope and at the same time enables attachment of the left edge of the receipt ply to the intermediate ply 20. This enables a receipt ply to remain attached to the envelope top (intermediate ply 20) and then to be removed by the end user (the bank) after opening the sealed envelope.

The narrow flap construction of form 62 is advantageous for reducing material cost and provides a method for exposing information on the intermediate ply 72 after sealing the envelope. The narrow flap 108 includes the line of weakening 110 which acts as a hinge point relative to the pocket to enable convenient manufacture and packaging of the closure ply in a prefolded arrangement of the business form.

It is thus seen that herein shown and described is a multiple ply document for receiving data or information, which document comprises a cover ply, an intermediate ply, a back ply of larger size and secured to the intermediate ply, and one or more additional plies of lesser size than the back ply. A portion of one or more of the additional plies is removed along a respective line of weakening and one of the additional plies is then placed into the envelope or pocket formed by the back ply and the intermediate ply.

The document of the present invention enables the accomplishment of the objects and advantages mentioned above, and while a preferred embodiment and a modification thereof have been disclosed herein, other variations may occur to those skilled in the art. It is contemplated that all such variations not departing from the spirit and scope of the invention hereof are to be construed in accordance with the following claims.

What is claimed is:

1. A multiple ply business form comprising a back ply of one width having a control margin along one side thereof, an intermediate ply of lesser width than said back ply and secured to said back ply by first securing means along at least two edges of the back ply and of the intermediate ply to form a pocket, at least one additional ply secured by second securing means to said intermediate ply along one edge thereof to secure a first portion of the additional ply to the intermediate ply and including a line of weakening spaced from said one edge of said intermediate ply and adjacent said second securing means permitting removal of a second portion of the additional ply and leaving said first portion secured to the intermediate ply, the pocket formed by said back ply and said intermediate ply being of a size to accommodate the second portion of said additional ply in a flat, unfolded condition, and a closure ply having a line of weakening connecting said closure ply and said back ply and foldable along said connecting line of weakening over the intermediate ply for sealing the removed second portion of the additional ply which has been inserted in the pocket for record purposes.

2. The business form of claim 1 wherein the back ply is of one weight material and said one additional ply is of a lighter weight material.

3. The business form of claim 1 wherein the additional ply is smaller in size than the intermediate ply.

4. The business form of claim 1 wherein said first securing means comprises a line of adhesive along each of said two edges of the back and the intermediate plies to form a pocket.

5. The business form of claim 1 wherein the second securing means comprises a plurality of spots of adhesive in a matrix pattern.

6. The business form of claim 1 wherein the closure ply folds over along said connecting line of weakening to substantially cover the business form.

7. The business form of claim 1 wherein the closure ply folds over along said connecting line of weakening to cover a portion of the business form.

8. The business form of claim 7 wherein said connecting line of weakening acts as a hinge point relative to the pocket to enable convenient access to the pocket and wherein the closure ply is a prefolded flap in the manufacture and packaging of the business form to provide a cover for a portion of the business form.

9. The business form of claim 1 wherein said closure ply includes a second line of weakening spaced from said connecting line of weakening and provides a hinge for access to information on the removed portion of the additional ply after the pocket has been sealed and then reopened.

10. The business form of claim 1 wherein said first securing means comprises a line of adhesive positioned along three edges on the back ply or the intermediate ply to form a pocket and said second securing means comprises a plurality of spots of adhesive positioned over one of said lines of adhesive and along one edge of said intermediate ply for securing an additional ply thereto.

11. The business form of claim 1 wherein said connecting line of weakening acts as a hinge point relative to the pocket and said intermediate ply includes a line of weakening spaced from said connecting line of weakening and forming an edge portion and acting as a hinge to permit access to said pocket, and said closure ply engaging with said edge portion to close said pocket after inserting the second portion of said additional ply into said pocket.

12. A business form for use with an automated machine and comprising a first ply of one width having a control margin along one side thereof, a second ply of lesser width than said first ply and secured to said first ply by first securing means along at least two edges of the first ply and of the second ply to form a pocket, at least one third ply for recording information thereon and having a first portion thereof secured by second securing means to said second ply along one edge thereof and having a line of weakening spaced from said one edge of said second ply and adjacent said second securing means permitting removal of a remaining portion of the third ply and leaving said first portion secured to the second ply, the pocket formed by said first ply and said second ply being of a size to accommodate the remaining portion of said third ply in a flat, unfolded condition, and a closure ply having a fold line of weakening normal to the line of weakening on the third ply and connecting said closure ply and said first ply and foldable along said fold line of weakening over said second ply for sealing a removed portion of the third ply which has been inserted in the pocket for providing a sealed record of the information on said third ply.

13. The business form of claim 12 wherein said first securing means comprises a line of adhesive along each of said two edges of the first and the second plies to form a pocket.

14. The business form of claim 12 wherein said second securing means comprises a plurality of spaced dots of adhesive in a matrix pattern.

15. The business form of claim 12 wherein the closure ply includes a pressure sensitive adhesive tape for sealing the pocket.

16. The business form of claim 12 wherein the closure ply includes a remoistenable adhesive for sealing the pocket.

17. The business form of claim 12 wherein the closure ply folds over along said connecting fold line of weakening to substantially cover the business form.

18. The business form of claim 12 wherein the closure ply folds over along said connecting fold line of weakening to cover a portion of the business form.

19. The business form of claim 12 wherein said first securing means comprises a line of adhesive positioned along three edges on the first ply or the second ply to form a pocket and said second securing means comprises a plurality of spots of adhesive positioned over one of said lines of adhesive and along one edge of said second ply for securing a third ply thereto.

20. The business form of claim 12 wherein said connecting line of weakening acts as a hinge point relative to the pocket and said second ply includes a line of weakening spaced from said connecting line of weakening and forming an edge portion and acting as a hinge to permit access to said pocket, said second ply being void of second securing means on said edge portion, and said closure ply engaging with said edge portion to close said pocket after inserting the remaining portion of the third ply into said pocket.

* * * * *